US005224220A

United States Patent [19]

Andriola

[11] Patent Number: 5,224,220

[45] Date of Patent: Jul. 6, 1993

[54] EASY OFF SPORTS GLOVE ATTACHMENT

[76] Inventor: Nick A. Andriola, 34 Roselle Ave. W., Roselle Park, N.J. 07204

[21] Appl. No.: 732,840

[22] Filed: Aug. 12, 1991

[51] Int. Cl.[5] ..... A41D 19/00

[52] U.S. Cl. ..... 2/160; 2/163

[58] Field of Search ..... 2/159, 161 A, 160, 163, 2/161 R, 271, 16, 20, 19, 2, DIG. 6; 223/111

[56] References Cited

U.S. PATENT DOCUMENTS

| | | | |
|---|---|---|---|
| 822,868 | 6/1906 | Pribil, Jr. et al. | 2/158 X |
| 3,152,337 | 10/1964 | Barry | 2/161 A |
| 3,408,657 | 11/1968 | Gallagher | 2/161 A |
| 4,368,883 | 1/1983 | Tiktin | 2/163 X |
| 4,796,306 | 1/1989 | Mitchell | 2/160 |
| 5,022,094 | 6/1991 | Hames et al. | 2/159 X |

*Primary Examiner*—Clifford D. Crowder
*Assistant Examiner*—Sara M. Current

[57] ABSTRACT

An attachment for assisting the removal of tight-fitting gloves is provided which uses a set of five pull strings, each of which is attached at one end to the end of a glove finger and each string has a second end attached to a pad of hook or loop fastener material which in turn attaches to a mating fastener pad of hook or loop fastener material which is fastened to the back of the glove. The strings are of sufficient length to allow free finger movement when the glove is worn. To remove the glove, the wearer simply lifts the pad which is attached to the pull strings and pulls off all five fingers of the glove at once.

1 Claim, 1 Drawing Sheet

EASY OFF SPORTS GLOVE ATTACHMENT

BACKGROUND OF THE INVENTION

Sports gloves are usually tight fitting (especially baseball batting gloves.) Because of their tight fit, sports gloves are often difficult for the wearer to remove; typically, the wearer must remove them by pulling them off, one finger at a time. This invention eliminates the struggle to remove gloves finger by finger by providing a glove attachment which allows for removal of all five glove fingers at once.

SUMMARY OF THE INVENTION

The present invention uses a set of five pull strings, cords, leather or nylon strips, each of which has a first end attached to the end of a glove finger and a second end attached to a pad of hook or loop fastener material (such as the type sold under the tradename VELCRO) which in turn attaches to a mating fastener pad on the back of the glove body. The pull strings are of sufficient length to allow free finger movement when the glove is worn.

DESCRIPTION OF THE PREFERRED EMBODIMENT

Figure 1:
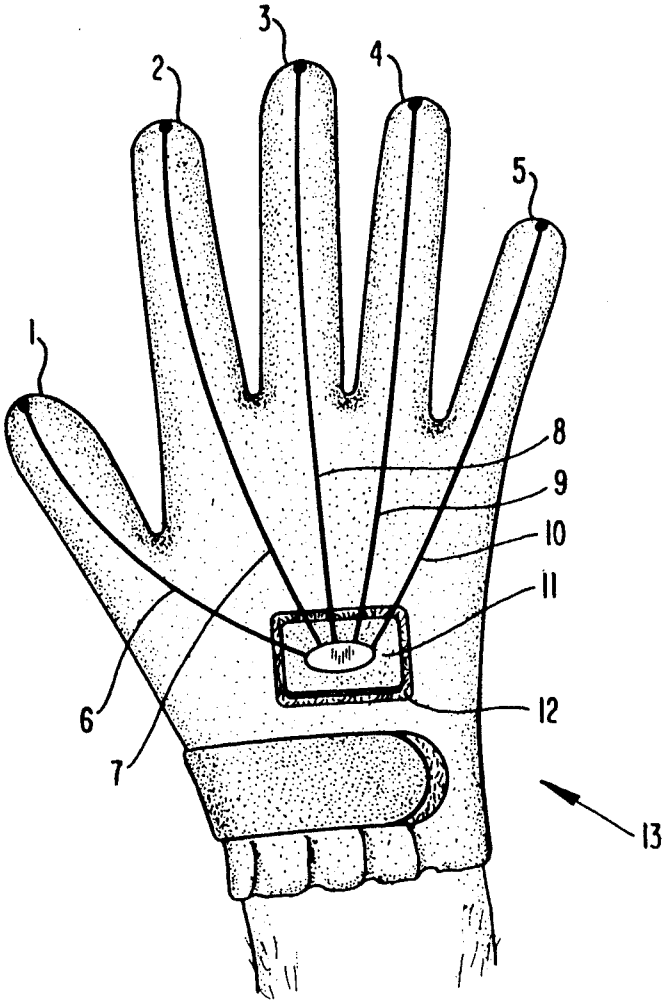
FIG. 1 is a planar view of the back of a glove according to the present invention.

The preferred embodiment of the invention is shown as glove 13 in FIG. 1. The glove has five finger portions 1, 2, 3, 4 and 5 with each finger portion respectively having attached to its tip a pull string (numbered 6, 7, 8, 9 and 10.) Each of the pull strings has a second end opposite the end attached to the finger portions, with the second end of each pull string being attached to a pad of hook or loop fastener material 11. A mating fastener pad 12 is attached to the back of glove 13 so that tab 11 may selectively be attached to the glove back, with pull strings 6, 7, 8, 9 and 10 being of sufficient length to allow for free finger movement when the pad 11 is attached to pad 12.

Figure 2:
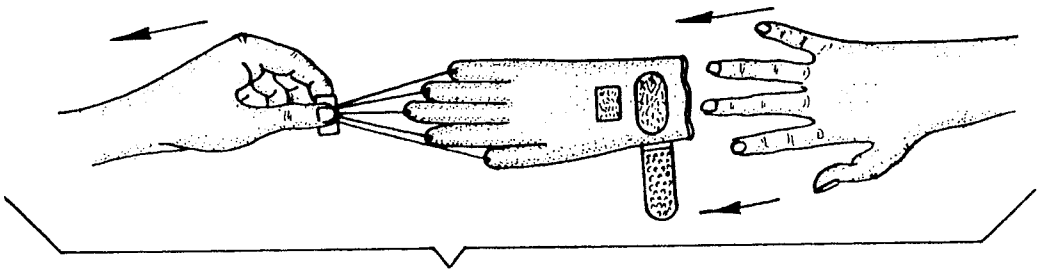
FIG. 2 is a view of a wearer removing a glove like the one shown in FIG. 1.
Figure 3:
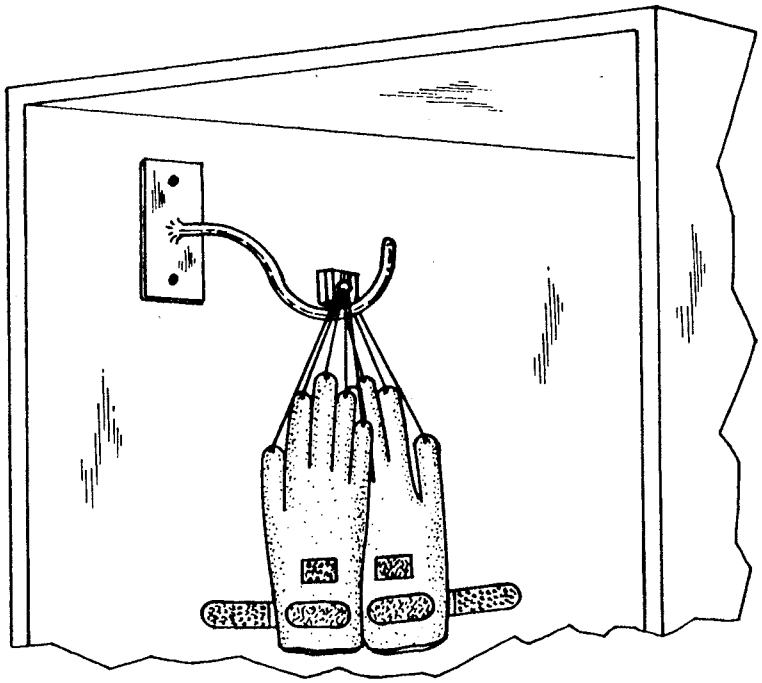
FIG. 3 is a view of a pair of the easy-off gloves having their tabs joined together so that they may be hung on a hook.

When the wearer wishes to remove glove 13, as shown in FIG. 2, he simply lifts pad 11 from the back of the glove and pulls the glove off, all five fingers at once. FIG. 3 depicts a pair of the gloves of the preferred embodiment having the fastener pads 11 from the two gloves joined together so that the glove pair may be hung by the pull strings.

I claim:

1. A sports glove comprising:

a glove back for covering the back of a wearer's hand;

five finger portions for covering the five digits of a wearer's hand, each finger portion having a tip for enclosing the ends of a wearer's fingers; and a set of five pull strings wherein each pull string has a first end and a second end and wherein each finger portion has a first end of a pull string attached to the tip of the finger portion; and a first fastener pad of hook or loop fastener material wherein each of the second ends of the five pull strings is attached to said first fastener pad; and a second fastener pad of hook or loop fastener material attached to the glove back wherein said first fastener pad releasably attaches to said second fastener pad; and wherein said pull strings are of sufficient length so that when the glove is worn and said first fastener pad is attached to said second fastener pad the strings allow for free movement of the wearer's fingers.

* * * * *